United States Patent [19]

Roach et al.

[11] Patent Number: 4,559,436

[45] Date of Patent: Dec. 17, 1985

[54] HEAT EXCHANGER TUBE REPAIR

[75] Inventors: Peter F. Roach, Warrington; Edward Duncombe, Altrincham; Ian Hulse, Warrington, all of England

[73] Assignee: United Kingdom Atomic Energy Authority, London, England

[21] Appl. No.: 596,720

[22] Filed: Apr. 4, 1984

[30] Foreign Application Priority Data

Apr. 13, 1983 [GB] United Kingdom ..... 8309988

[51] Int. Cl.[4] ..... B23K 1/20

[52] U.S. Cl. ..... 219/85 M; 219/60.2; 219/85 R; 228/119

[58] Field of Search ..... 219/85 R, 85 A, 85 D, 219/85 E, 85 M, 60.2, 66; 228/119; 29/157.3 C, 157.4, 402.09, 402.16; 285/114 CM

[56] References Cited

U.S. PATENT DOCUMENTS

| | | | |
|---|---|---|---|
| 3,806,693 | 4/1974 | Miller | 219/60.2 X |
| 4,283,615 | 8/1981 | Vrillon | 219/66 |
| 4,386,458 | 6/1983 | Evans | 219/7.5 X |
| 4,448,343 | 5/1984 | Kochka et al. | 228/119 X |

FOREIGN PATENT DOCUMENTS

| | | | |
|---|---|---|---|
| 1170434 | 5/1964 | Fed. Rep. of Germany | 29/157.4 |

OTHER PUBLICATIONS

Olds, F. C., "Sleeving Saves Nuclear Steam Generator Tubes", *Power Engineering* (Dec. 1981), pp. 73–75.

*Primary Examiner*—C. L. Albritton
*Assistant Examiner*—Catherine M. Sidga
*Attorney, Agent, or Firm*—William R. Hinds

[57] ABSTRACT

Prior to effecting a repair of a leaking heat exchanger tube by an internal repair tube brazed to the leaking tube, strain in the leaking tube is measured while heating it to brazing temperature. A braze is only effected if the strain is below a predetermined level. Apparatus for carrying out the strain measurement typically of probe form having a strain gauge head (21) at the nose of the probe and a heater element (23). Preferably, the length of the probe is such that the head (21) reaches to just above a grid support plate (12). Where strain is found to be above said predetermined level and the leaking tube is of U-shape the strain may be relieved by heating both legs of the tube. Alternatively, strain may be relieved by thinning and bulging the leaking tube (FIGS. 5A–C) at a region close enough to the braze for the thinned zone to experience heat from the braze to allow it to yield under the strain.

4 Claims, 9 Drawing Figures

HEAT EXCHANGER TUBE REPAIR

This invention relates to the repair of heat exchanger tubes.

BACKGROUND OF THE INVENTION

There is currently a problem in the nuclear field, and probably in other fields, where a leak at a tube in a nest of tubes where it is welded to a tube plate in a neat exchanger has to be made good without gaining access to the outside of the tube. The practice for dealing with this problem is to insert a length of repair tube into the leaking tube through the tube plate with one (the outer) end of repair tube explosively welded to the tube plate and the other (the inner) end brazed to the leaking tube.

We have now discovered that the quality of the braze can be affected by the presence of strain in the tube being repaired, such strain arising during the heating necessary to effect the braze. A predetermined tolerable level of said strain can be assessed by tests involving the brazing of specimens under various strains and then inspecting the brazes.

FEATURES AND ASPECTS OF THE INVENTION

The present invention provides a method for the repair of a leaking heat exchanger tube in a nest of tubes welded to a tube plate in which the tube is either of U-tube shape or passes through one or more support grid plates, said method involving the known step of inserting a length of repair tube into the leaking tube with one end of the repair tube brazed to the leaking tube characterised in that compressional strain in the leaking tube is measured whilst heating the tube to the brazing temperature and the brazing is only effected if the strain is below a predetermined level.

The invention also provides apparatus for carrying out the above method, said apparatus being in the form of a probe which can enter along the leaking tube and having at the nose of probe a strain gauge head of the kind which can be held in contact with and later released from the inside wall of the leaking tube and having, in the body of the probe, a heater element for internally heating the leaking tube.

Strain, of a magnitude sufficient to impede the brazing process, does not always occur when a tube is heated. When it does it may be due to the fact that the complete heat exchanger tube is "U" shaped and heating one leg will cause a strain, the magnitude of which is dependent on the bend radius. On the other hand, the stress may be caused by the tube binding in the first (top) support grid plate or any of the lower grid plates through which it passes. In either case, the strain produced may be higher than can be tolerated.

To enable the strain to be measured regardless of its cause, the length of the probe apparatus is such that, for a given heat exchanger, the strain gauge head reaches a region close to but just above the first tube support grid plate. For practical reasons, the heater (and heated region) is kept as remote from the strain gauge as possible, the heater extending downwards from just below the tube plate.

DESCRIPTION OF THE DRAWINGS

The invention will now be described further with reference to the accompanying drawings in which.

DESCRIPTION OF PREFERRED EMBODIMENTS

Figure 1:
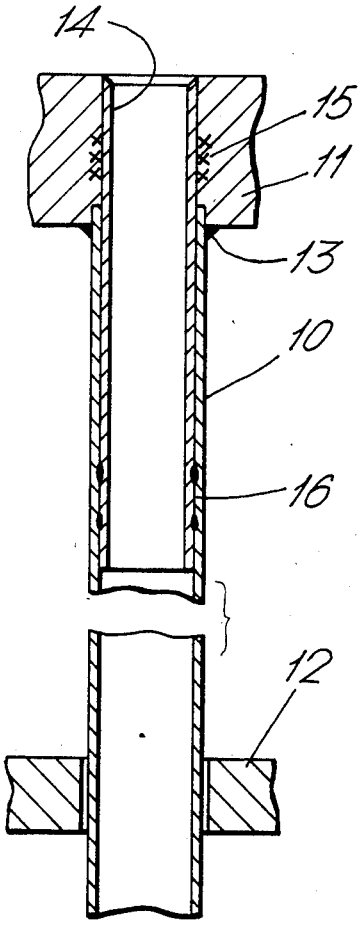
FIG. 1 is a cross-sectional elevation of a repaired leaky tube, the figure being used for explanatory purposes.

In FIG. 1 a repaired tube 10 is shown. This tube 10 is one of a nest of similar "U" shaped tubes in a heat exchanger having a tube plate 11 and a top tube support grid plate 12. The tube 10 is welded to the tube plate at a weld 13. It is this weld that can leak after the heat exchanger has been used and it is inaccessible for repair because of the close proximity of other tubes in the nest. If the heat exchanger has been in use as a part of a nuclear reactor installation it is probable that the weld is also inaccessible because of nuclear activation.

It is already known to repair a leak arising at weld 13 by inserting a repair tube 14 which is explosively welded to the tube plate at weld 15 (indicated by X's) and brazed to the tube 10 at a braze 16.

However, in carrying out this known repair (which involves a high temperature—red heat—on the tube 10 to effect the braze) a stress can arise in the tube 10 if the tube 10 is not sufficiently free when expanding. This stress is found to affect the quality of the braze 16 and in particular the evenness of the braze is disturbed.

Figure 2:
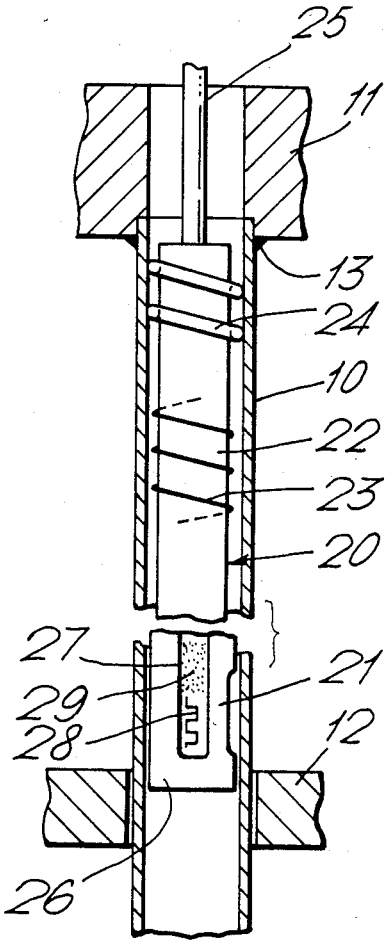
FIG. 2 is a cross-sectional elevation of a leaky tube having inserted therein a probe according to the invention in order to carry out a test according to the invention.

With this discovered, and in accordance with the invention, the tube 10 is subjected to a strain-on-heating test prior to effecting the repair. This is illustrated with reference to FIG. 2.

A probe form of apparatus 20 is inserted into the tube 10. A probe has at its nose a strain gauge head 21. The body 22 of the probe extends from the tube plate 11 to a point close to the gauge head 21, space being left for a junction box 30 (see FIG. 4) between the body 22 and gauge 21. The body has an electric heater coil 23 and a coil spacer 24. Service connectors to the probe are indicated diagrammatically by the tube 25 and are described in more detail below.

The strain gauge is of the kind disclosed in GB-PS No. 1,395,263. This gauge has a casing 26 and windows 27 at 90° through which strain gauges 28 having abrasive surfaces 29 can be advanced by a pressure internal to the casing 26. The pressure urges the surfaces 29 into non-slip engagement with the tube 10. This action can be performed remotely by air pressure in a line in the services tube 25. Disengagement of the gauges 28 and tube 10 is effected by releasing the air pressure. In this application of the gauge described above, only one strain gauge is used. The second being held as a spare.

In use the tube 10 is heated by the coil 23 and the strains in gauge 28 are monitored. If strain below a predetermined level is registered then the repair shown in FIG. 1 can be made.

Reference is made to our European patent application No. 83 306812.5 which discloses apparatus suitable for making said repair.

Figure 3A:
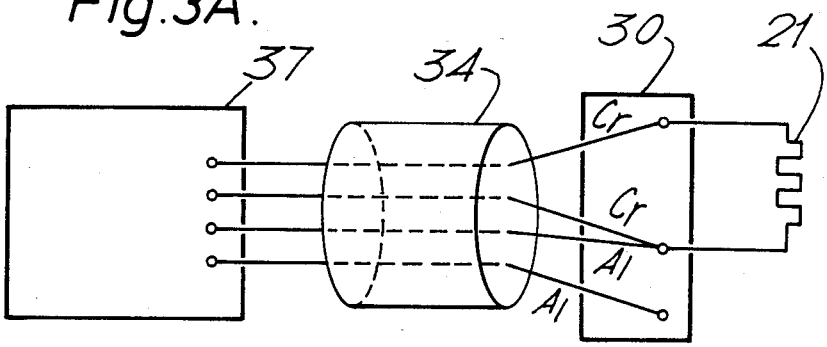
FIGS. 3A–C are diagrams showing various arrangements of a measuring system.
Figure 4:
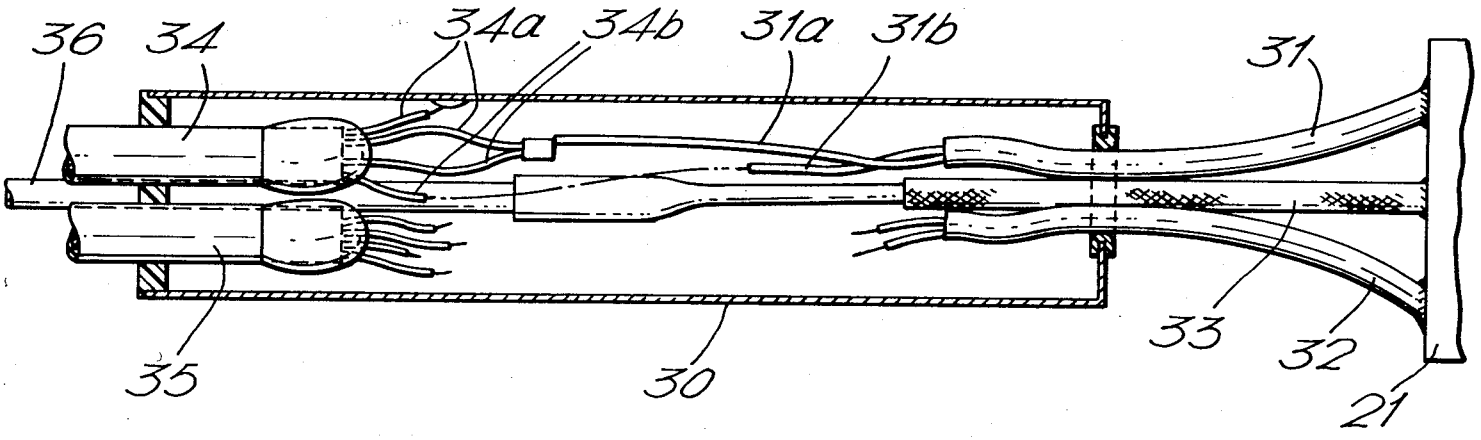
FIG. 4 is a diagram illustrating a junction box.

The probe apparatus 20 will now be described in greater detail with reference to FIGS. 3A, B and C and FIG. 4 of the drawings.

FIG. 3 shows various schematic arrangements of the measuring system. When using a strain gauge of the kind disclosed in GB-PS No. 1,395,263, the service lines must pass through the heated zone and must therefore be of a high temperature type (e.g. mineral insulated cable).

A junction box is required to join the flexible, relatively low temperature service lines used on the gauge described in GB-PS No. 1,395,263, to the rigid high temperature lines required. This box is shown in FIG. 4.

The gauge head 21 has two two-wire cables 31, 32, (one for each strain gauge) and a plastic tube air line 33.

At the junction box the wires 31*a*, 31*b* of cable 31 are connected to wires 34*a* and 34*b*, respectively of mineral insulated thermocouple cable 34. The wires of cable 32 are similarly connected to the wires of mineral insulated cable 35. The line 33 is connected to a rigid air tube 36. The cables 34, 45 are both four-wire mineral insulated thermocouple cable having two Alumel conductors and two Chromel conductors. When the instrument is in use, one of these cables is coupled with a four terminal digital strain indicator 37. The conductors are disposed within the junction box as shown in one or other of FIGS. 3A–C. The air line 33 has a glass sleeve covering.

The heater element 23 comprises five-start helical coils of swaged heater cable (1 mm) wound round the body 22. The cable has unswaged, thicker tails which pass outside the tube 25. The swaged coils are held in place on the body 22 with tack welded thin stainless-steel plates. The body 22 is penetrated at a point midway along the element 23 to provide a thermocouple junction at the end of a thermocouple cable which passes along the tube 25 and body 22 so that the temperature of the tube 10 can be assessed.

Figure 3B:
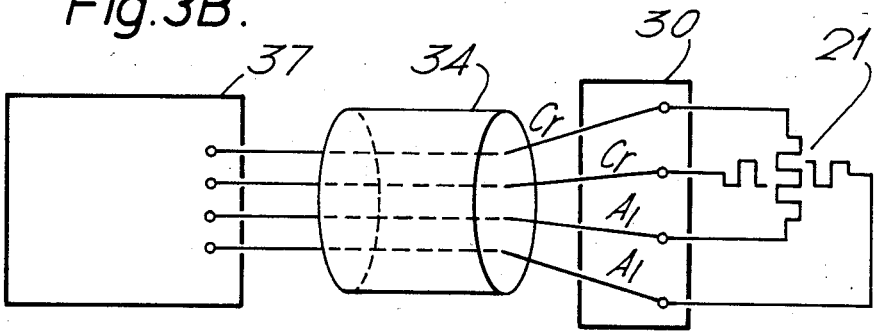
Figure 3C:
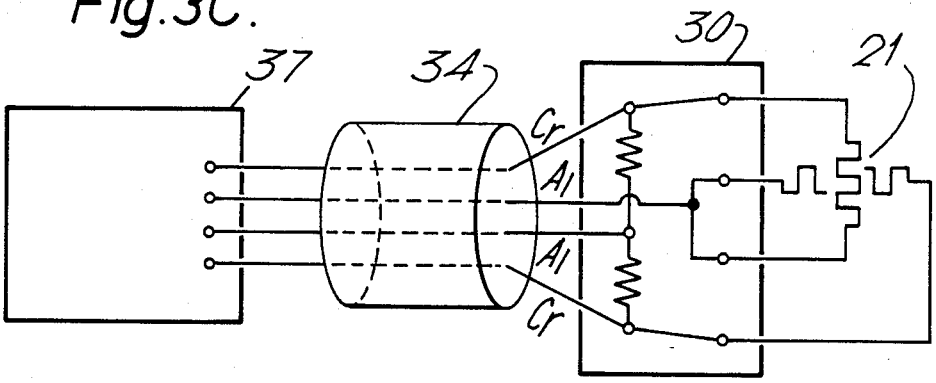

The coils spacers 24 (each of 1.5 mm diameter wire) centralise the heater in the tube 10 and are held in position by thin tack welded plates. Thus spacers can be provided at the end and centre of the body 22. In FIGS. 3A–C various ways of connecting the strain gauge 21 to a digital strain indicator 37 via a junction box 30 and 4-core mineral insulated cable 34 are shown. FIG. 3A is a quarter bridge arrangement and FIG. 3B is a half bridge arrangement. The conductors are marked "Cr" for a Chromel conductor and "Al" for an Alumel conductor. FIG. 3C shows a fully compensated arrangement.

Connections to the spare gauge (via cable 35—FIG. 4) are identical.

From time-to-time use of the invention will expose situations in which the strain is such that a braze cannot be made until the strain is relieved. Two ways are now described of effecting strain relief.

When the tube being repaired is of U-shape the principal strain may be caused by the fact that one leg of the U-shape is being heated whilst the other is not. The magnitude of this basic strain tends to be related to the spacing apart of the legs of the U-shape: a wide spacing gives low strain whilst a close spacing gives a higher strain. Such strains can be relieved by executing a heating step on one leg whilst the other leg is also heated. Said other leg may even be given a repair tube so that both legs have equal treatment even though a leak on the other leg does not exist.

Alternatively, the principal strain may be caused by the leaking tube binding in a support grid plate. Such strain can be relieved by creating in the leaking tube, in the region between weld and braze, a weakness zone so that the tube strain relieves itself at that zone when heated.

Problems arise in choosing the best way to create a weakness zone. A weakness created by simple thinning of the tube does not give the required strain relief, neither does cutting nor drilling. Cutting and drilling is also undesirable as it causes loss of back-up containment that the leaking tube provides despite the fact that is has a leak. This loss also arises if the leaking tube is severed.

Preferably the weakness zone is created first by a thinning operation (such as by undercutting) and second by an expansion or bulging operation at the point of thinning. The expansion or bulging can be performed by using an axially compressed recoverable isostatic ring, such as a rubber ring. With such a zone created, strain arising by the heating of the heat exchanger tube relieves itself at least to a degree not affecting the braze.

Figure 5A:
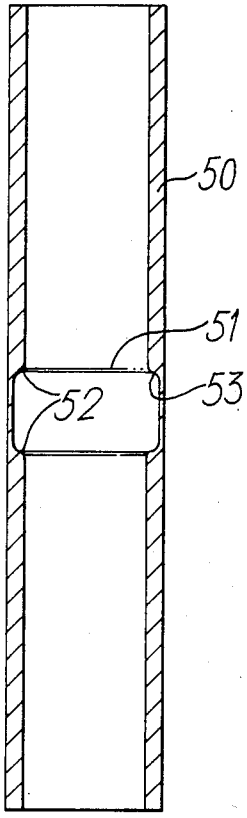
FIGS. 5A, 5B and 5C show three stages in treating an overstrained tube.

This approach to strain relief will now be described further with reference to FIGS. 5A, 5B and 5C.

In FIG. 5, a leaky heat exchanger tube 50 having an external diameter of 25 mm and a wall thickness of 2.5 mm is given an annular undercut 51 to remove 2 mm of wall thickness over a length of 12 mm. Sharp corners 52 are removed and the undercut has rounded corners 53. The undercut is made above the region at which a braze is to be effected between the tube 50 and a repair tube but close enough to experience the heat of the braze.

Figure 5C:
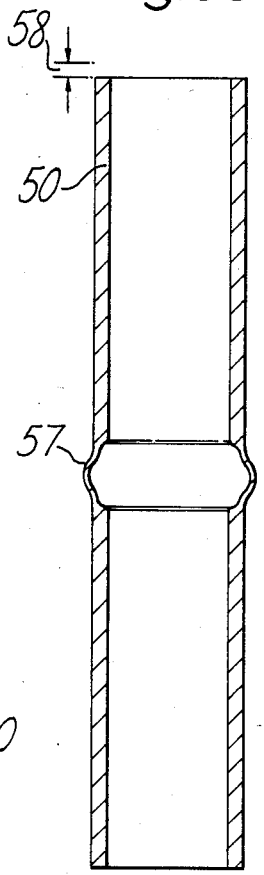
Figure 5B:
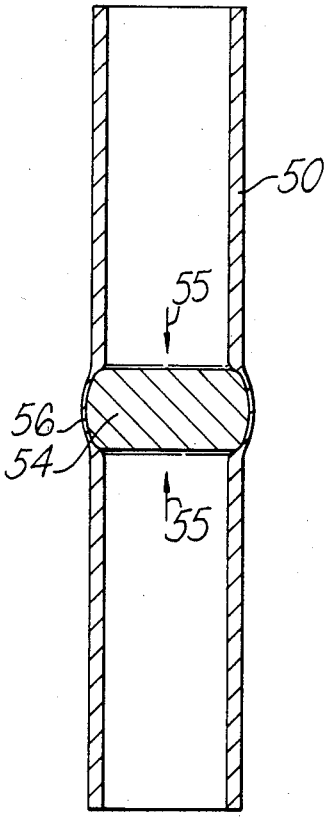

In FIG. 5B a rubber plug 54 is shown subjected to axial compression (arrows 55) so that it expands into the undercut 51 to give the tube 10 a bulge 56 at the undercut.

FIG. 5C shows the shape 57 taken by the undercut 51 when the tube 50 yields (arrows 58) 1.5 mm, on being heated due to the fact that the tube 50 is binding in a grid plate. Yield takes place at about 900° C. The braze is effected at about 1000° C. In this way no troublesome axial strain exists in the heat exchanger tube 50 during the course of the braze and hence there is no tendency for the tube 50 to distort under the strain in the region of the braze. Such distorting, if it occurs, is believed to cause unsatisfactory brazing as the capillary gap between the tube 50 and the repair tube becomes irregular and the braze metal does not spread uniformly.

We claim:

1. A method for the repair of a heat exchanger tube in a nest of tubes welded to a tube plate which tube is leaking where it is welded to said tube plate and which tube is either of U-tube shape or passes through one or more support grid plates, said method involving the known step of inserting a length of repair tube into the leaking tube with the inserted end of the repair tube brazed to the leaking tube and the other end of the repair tube explosively welded to the tube plate, characterized in that compressional strain in the leaking tube is measured whilst heating the tube to the brazing temperature and the brazing is only effected if the strain is below a predetermined level.

2. Apparatus for use in performing a method of repairing a leaking heat exchanger tube, said apparatus including a probe which can enter along the leaking tube, the probe having a nose at which is disposed a strain gauge head of the kind which can be held in contact with and later released from the inside wall of the leaking tube, the probe having a body and, within said body, a heater element for internally heating a leaking tube.

3. Apparatus as claimed in claim 2 in conjunction with a leaking tube passing through a support grid plate in which the length of the probe is such that the strain gauge head reaches close to but just above the support grid plate.

4. Apparatus as claimed in claim 2 in which the strain gauge has flexible low temperature connectors to a junction box at which connections are made to a rigid air line and four-wire mineral insulated thermocouple cable to a four-terminal strain indicator giving either a quarter bridge, half bridge, or fully compensated arrangement.

* * * * *